US011549207B2

(12) United States Patent
Bae et al.

(10) Patent No.: US 11,549,207 B2
(45) Date of Patent: Jan. 10, 2023

(54) WASHING MACHINE AND METHOD FOR CONTROLLING THE SAME

(71) Applicant: LG Electronics Inc., Seoul (KR)

(72) Inventors: Suncheol Bae, Seoul (KR); Kyunghoon Kim, Seoul (KR); Junghun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 259 days.

(21) Appl. No.: 16/778,853

(22) Filed: Jan. 31, 2020

(65) Prior Publication Data

US 2020/0248358 A1 Aug. 6, 2020

(30) Foreign Application Priority Data

Feb. 1, 2019 (KR) ..... 10-2019-0014061

(51) Int. Cl.

| | |
|---|---|
| ***D06F 33/48*** | (2020.01) |
| ***D06F 37/20*** | (2006.01) |
| *D06F 103/26* | (2020.01) |
| *D06F 33/44* | (2020.01) |
| *D06F 103/24* | (2020.01) |
| *D06F 37/04* | (2006.01) |

(52) U.S. Cl.

CPC ..... *D06F 33/48* (2020.02); *D06F 37/20* (2013.01); *D06F 33/44* (2020.02); *D06F 37/04* (2013.01); *D06F 2103/24* (2020.02); *D06F 2103/26* (2020.02)

(58) Field of Classification Search

CPC ..... D06F 33/48

See application file for complete search history.

(56) References Cited

U.S. PATENT DOCUMENTS

| | | | |
|---|---|---|---|
| 5,293,760 | A | 3/1994 | Tani et al. |
| 2009/0183319 | A1 | 7/2009 | Chai et al. |

FOREIGN PATENT DOCUMENTS

| | | |
|---|---|---|
| EP | 2000576 | 12/2008 |
| EP | 2470709 | 7/2012 |
| KR | 1994-0008628 | 9/1994 |

OTHER PUBLICATIONS

Extended European Search Report in European Application No. 20154839.3, dated Jun. 9, 2020, 11 pages.

*Primary Examiner* — Jason Y Ko

(74) *Attorney, Agent, or Firm* — Fish & Richardson P.C.

(57) ABSTRACT

A washing machine includes a washing tub configured to accommodate laundry therein, a motor configured to rotate the washing tub, and a controller. The controller is configured to: determine a laundry amount and a laundry-tangled degree by using a plurality of types of data that are measured while rotating the washing tub at a specific rotational speed; set an allowable unbalance (UB) value corresponding to the laundry amount and the laundry-tangled degree; determine a UB value based on rotating the washing tub during a dewatering stroke; and control the motor to stop rotating the washing tub based on the UB value exceeding the allowable UB value.

10 Claims, 6 Drawing Sheets

FIG. 7A

[FIXED UB TABLE]

| | DEWATERING SECTIONS | | | | | | |
|---|---|---|---|---|---|---|---|
| LAUNDRY AMOUNT | 1st SECTION | 2nd SECTION | 3rd SECTION | 4th SECTION | 5th SECTION | ... | Nth SECTION |
| FOURTH LEVEL (Lv.4) | a | b | c | d | e | ... | f |

FIG. 7B

[ACTIVE UB TABLE]

| | | DEWATERING SECTIONS | | | | | | |
|---|---|---|---|---|---|---|---|---|
| LAUNDRY AMOUNT | LAUNDRY -TANGLED DEGREE | 1st SECTION | 2nd SECTION | 3rd SECTION | 4th SECTION | 5th SECTION | ... | Nth SECTION |
| FOURTH LEVEL (Lv.4) | FIRST STEP (class 1) | a0 | b0 | c0 | d0 | e0 | ... | f0 |
| | SECOND STEP (class 2) | a1 | b1 | c1 | d1 | e1 | ... | f1 |

WASHING MACHINE AND METHOD FOR CONTROLLING THE SAME

CROSS-REFERENCE TO RELATED APPLICATION

Pursuant to 35 U.S.C. § 119(a), this application claims the benefit of the earlier filing date and right of priority to Korean Application No. 10-2019-0014061, filed on Feb. 1, 2019, the contents of which are incorporated by reference herein in their entirety.

TECHNICAL FIELD

The present disclosure relates to a washing machine and a method for controlling the same, and more particularly, to a washing machine capable of performing artificial intelligence-based machine learning dewatering, and a method for controlling the same.

BACKGROUND

A washing machine is a device that can remove dirt from laundry (hereinafter also referred to as "fabric") such as clothing, bedding, etc. by using chemical cleaning action of water and detergent and physical action such as friction between water and the laundry.

A washing machine may be classified into an agitator type, a pulsator type, and a drum type. The drum type washing machine may include a water storage tank (or tub) for storing water and a washing tub (or drum) rotatably disposed in the water storage tank to accommodate laundry therein.

The washing tub (or drum) may have a plurality of through holes through which water passes. A washing operation may be divided into a washing stroke (cycle), a rinsing stroke (cycle), and a dewatering stroke (cycle). In some cases, a process of each stroke may be displayed through a control panel (or display) provided outside a washing machine.

The washing stroke may include an operation to remove dirt from laundry using friction between water stored in the water storage tank and the laundry placed in the washing tub and chemical cleaning action of detergent in water.

The rinsing stroke may include an operation to rinse the laundry with clean water to remove the detergent soaked (adhered) during the washing stroke by supplying clean water (no detergent dissolved) into the water storage tank. A fabric softening agent may be supplied together with the water during the rinsing stroke.

The dewatering stroke may include an operation to remove water from the laundry by rotating the washing tub at high speed after the rinsing stroke is finished. In some cases, an entire washing operation of the washing machine may be finished with an end of the dewatering stroke. In some cases, for examples, in the case of a combo washer dryer, a drying stroke may be further added after the dewatering stroke.

In some examples, the washing operation may be set to operate under a different condition depending on a load or amount of laundry (hereinafter also referred to as "amount of fabrics") placed in the washing tub. For example, a water level, washing strength, a drain time, a dewatering time, etc., may vary according to the amount of laundry.

In some cases, washing performance can vary according to not only the amount of the laundry but also a laundry type (fabric type). Therefore, when setting the washing operation only based on the amount of the laundry, sufficient washing performance may not be obtained.

In some cases, a washing machine may sense an amount of laundry and a fabric type. For example, the washing machine may sense the amount of laundry by using an average value of current values and detect the fabric type by using a current value deviation.

In a washing operation, laundry may need to be effectively or evenly loaded (distributed) in the dewatering stroke after the washing and rinsing strokes are finished. If the laundry is not evenly loaded and concentrated on one side, an unbalance (UB) of laundry may be generated, which may cause the washing tub to shake or vibrate. In some cases, a dewatering stroke time may become longer, and noise may become larger.

In some examples, the washing machine may include only a fixed UB table in which the allowable UB value, a criterion for initializing the dewatering process, is set according to the laundry amount. For instance, the fixed allowable UB value may only take the laundry amount into account without considering the laundry-tangled degree.

In some cases, where the laundry-tangled degree is not considered, the allowable UB value may be set somewhat larger in order to complete dewatering within a reasonable time even in the case of laundry with a high degree of tangling.

In some cases, unbalance may be large in the case of laundry having a high degree of tangling (clothes that get easily tangled), and unbalance may be small in the case of laundry having a low degree of tangling (clothes are not tangled easily).

The laundry having a low degree of tangling may enter a high-speed dewatering process without proper laundry balancing (laundry diffusion) since the allowable UB value is set to be large. In this case, noise may be generated as the high-speed dewatering process is performed for the laundry having a low degree of tangling in a state the laundry balancing is not properly performed.

Recently, there has been an increased interest in machine learning, artificial intelligence (AI), and deep learning.

In some examples, the machine learning may focus on statistics-based classification, regression, and cluster models. In particular, in supervised learning of the classification and regression models, the learning models that distinguish new data from characteristics of learning data based on these characteristics may be defined by a person in advance. Deep learning, on the other hand, is one in which a computer searches for and identifies its own characteristics.

One of the factors that accelerated development of the deep learning may be deep learning frameworks provided as an open source such as Theano of the University of Montreal, Canada, Torch of New York University, Caffe of the University of California, Berkeley, and TensorFlow of Google.

With the release of deep learning frameworks, in addition to deep learning algorithms, extraction and selection of data used for a learning process, a learning method, and learning are becoming more important for effective learning and recognition.

In addition, research is being actively conducted for applying artificial intelligence and machine learning to various products and services.

Development in employing artificial intelligence and machine learning in a dewatering stoke may improve an optimization of the dewatering stroke.

SUMMARY

The present disclosure describes a washing machine capable of setting an optimized UB value for a dewatering stroke according to a laundry amount and a laundry-tangled degree, and a method for controlling the same.

The present disclosure also describes a washing machine capable of minimizing or reducing dewatering noise by determining whether to interrupt a dewatering stroke based on an allowable UB value associated with a laundry amount and laundry-tangled degree, and a method for controlling the same.

The present disclosure describes a washing machine capable of reducing a dewatering time by applying a different allowable UB value depending on a measured laundry amount and laundry-tangled degree, and a method for controlling the same.

The present disclosure further describes a washing machine capable of providing a more precise dewatering control by determining whether to initialize a dewatering stroke based on an allowable UB value associated with a measured laundry amount and laundry-tangled degree using a UB table classified into a plurality of laundry-tangled degrees according to each laundry amount, and a method for controlling the same.

The tasks to be solved in the present disclosure may not be limited to the aforementioned, and other problems to be solved by the present disclosure will be obviously understood by a person skilled in the art based on the following description.

According to one aspect of the subject matter described in this application, a washing machine includes a washing tub configured to accommodate laundry therein, a motor configured to rotate the washing tub, and a controller. The controller is configured to: determine a laundry amount and a laundry-tangled degree by using a plurality of types of data that are measured while rotating the washing tub at a specific rotational speed; set an allowable unbalance (UB) value corresponding to the laundry amount and the laundry-tangled degree; determine a UB value based on rotating the washing tub during a dewatering stroke; and control the motor to stop rotating the washing tub based on the UB value exceeding the allowable UB value.

Implementations according to this aspect may include one or more of the following features. For example, the controller may be configured to set a different allowable UB value based on a change of one or both of the laundry amount and the laundry-tangled degree. In some examples, the controller may be configured to: during a rinsing stroke prior to the dewatering stroke, obtain the plurality of types of data based on rotating the washing tub at the specific rotational speed in which the laundry is lifted up by a predetermined height and then falls in the washing tub.

In some implementations, the controller may be configured to: input the plurality of types of data as an input value to a pre-learned Artificial Neural Network (ANN) that may be configured to output the laundry-tangled degree as a result value. In some examples, the controller may be configured to, based on operation through the pre-learned ANN, determine one of a plurality of laundry-tangled degrees, the pre-learned ANN being configured to classify each of the plurality of laundry-tangled degrees into one of a plurality of steps.

In some implementations, the controller may be configured to: set the allowable UB value to a first value based on the laundry-tangled degree corresponding to a first step; and set the allowable UB value to a second value that is greater than the first value based on the laundry-tangled degree corresponding to a second step that is greater than the first step.

In some implementations, the controller may be configured to: set the allowable UB value based on a UB table, in which the UB table includes a plurality of allowable UB values that have been determined based on a plurality of laundry amounts and a plurality of laundry-tangled degrees, and each of the plurality of laundry-tangled degrees is classified into one of a plurality of steps. In some examples, one of the plurality of laundry amounts may correspond to the plurality of laundry-tangled degrees, and the dewatering stroke may include a plurality of dewatering operation sections. The controller may be configured to, for each of the plurality of dewatering operation sections, set a plurality of allowable section UB values according to the plurality of laundry-tangled degrees, respectively.

In some implementations, the controller may be configured to: set the UB table to include the plurality of allowable section UB values, each of the plurality of allowable section UB values being associated with one of the plurality of laundry amounts and one of the plurality of laundry-tangled degrees that is output through a pre-learned ANN; determine a section UB value based on rotating the washing tub in a rotational speed during one of the plurality of dewatering operation sections; and interrupt the dewatering stroke based on the section UB value exceeding one of the plurality of allowable section UB values that is associated with the one of the plurality of laundry amounts and the one of the plurality of laundry-tangled degrees.

In some implementations, the washing machine may further include a sensor configured to detect a variation of a rotational speed of the washing tub, and the controller may be configured to determine the UB value based on the variation of the rotational speed of the washing tub detected during the dewatering stroke.

According to another aspect, a method is described for controlling a washing machine including a washing tub configured to receive laundry therein. The method includes: measuring a plurality of types of data while rotating the washing tub at a specific rotational speed; determining a laundry amount and a laundry-tangled degree using the plurality of types of data; and setting an allowable unbalance (UB) value associated with the laundry amount and the laundry-tangled degree, the allowable UB value being a criterion for stopping rotation of the washing tub in a dewatering stroke.

Implementations according to this aspect may include one or more of the following features. For example, setting the allowable UB may include setting a different allowable UB value based on a change of one or both of the laundry amount and the laundry-tangled degree. In some examples, measuring the plurality of types of data may include: during a rinsing stroke prior to the dewatering stroke, obtaining the plurality of types of data based on rotating the washing tub at the specific rotational speed in which the laundry is lifted up by a predetermined height and then falls in the washing tub.

In some implementations, determining the laundry amount and the laundry-tangled degree may include inputting the plurality of types of data as an input value to a pre-learned Artificial Neural Network (ANN) configured to output the laundry-tangled degree as a result value. In some examples, determining the laundry amount and the laundry-tangled degree may include: based on operation through the pre-learned ANN, determining one of a plurality of laundry-tangled degrees, the pre-learned ANN being configured to classify each of the plurality of laundry-tangled degrees into one of a plurality of steps.

In some implementations, setting the allowable UB value may include: setting the allowable UB value to a first value based on a determination that the laundry-tangled degree corresponds to a first step; and setting the allowable UB value to a second value that is greater than the first value based on a determination that the laundry-tangled degree corresponds to a second step that is greater than the first step.

In some examples, setting step the allowable UB value may include: setting the allowable UB value based on a UB table, in which the UB table includes a plurality of allowable UB values that have been determined based on a plurality of laundry amounts and a plurality of laundry-tangled degrees, and each of the plurality of laundry-tangled degrees is classified into one of a plurality of steps. In some examples, one of the plurality of laundry amounts may correspond to the plurality of laundry-tangled degrees, and the dewatering stroke may include a plurality of dewatering operation sections. In such examples, setting the allowable UB value may include: for each of the plurality of dewatering operation sections, setting a plurality of allowable section UB values according to the plurality of laundry-tangled degrees, respectively.

In some implementations, setting the allowable UB value may include: setting the UB table to include the plurality of allowable section UB values, each of the plurality of allowable section UB values being associated with one of the plurality of laundry amounts and one of the plurality of laundry-tangled degrees that is output through a pre-learned ANN. The method may further include: determining a section UB value based on rotating the washing tub in a rotational speed during one of the plurality of dewatering operation sections; and interrupting the dewatering stroke based on the section UB value exceeding one of the plurality of allowable section UB values that is associated with the one of the plurality of laundry amounts and the one of the plurality of laundry-tangled degrees.

In some implementations, the method may further include: determining a UB value based on rotating the washing tub during the dewatering stroke; and based on the UB value exceeding the allowable UB value, stopping rotation of the washing tub during the dewatering stroke.

In some implementations, in the dewatering stroke, when a UB value, measured by rotation of the washing tub, exceeds a preset allowable UB value, initialization (dewatering process is being stopped for a restart) is performed to evenly load the laundry so as to reduce the UB value. The initialization here may include re-running the dewatering process in order to restart the dewatering stroke from the beginning (or from a step (section) after detecting a dewatered laundry amount).

In some implementations, the present disclosure can provide an Al powered washing machine capable of performing optimized dewatering by setting (changing) an allowable UB value, a criterion for interrupting (initializing) a dewatering process, so as to correspond to an allowable UB value associated with a laundry amount and a laundry-tangled degree.

In some implementations, the present disclosure can provide an optimized washing machine capable of reducing a dewatering time by changing an allowable UB value based on a laundry-tangled degree even in the same amount of laundry each time a dewatering process is performed. Thus, in the case of laundry having a low degree of tangling, an allowable UB value is set to be small so as to reduce noise generated during dewatering, and in the case of laundry having a high degree of tangling, an allowable UB value is set to be large so as to reduce a dewatering time, and a method for controlling the same.

In some implementations, the present disclosure can provide a washing machine capable of performing sophisticated dewatering control by setting an allowable UB value differently according to a laundry-tangled degree as well as a laundry amount by using a UB table classified into a plurality of laundry-tangled degrees according to each laundry amount, and a method for controlling the same.

The effects of the present disclosure are not limited to those effects mentioned above, and other effects not mentioned may be clearly understood by those skilled in the art from the description of the appended claims.

BRIEF DESCRIPTION OF THE DRAWINGS

FIGS. 7A and 7B illustrate examples of UB tables.

DETAILED DESCRIPTION

Description will now be given in detail according to exemplary implementations disclosed herein, with reference to the accompanying drawings. For the sake of brief description with reference to the drawings, the same or equivalent components may be provided with the same or similar reference numbers, and description thereof will not be repeated.

Figure 1:
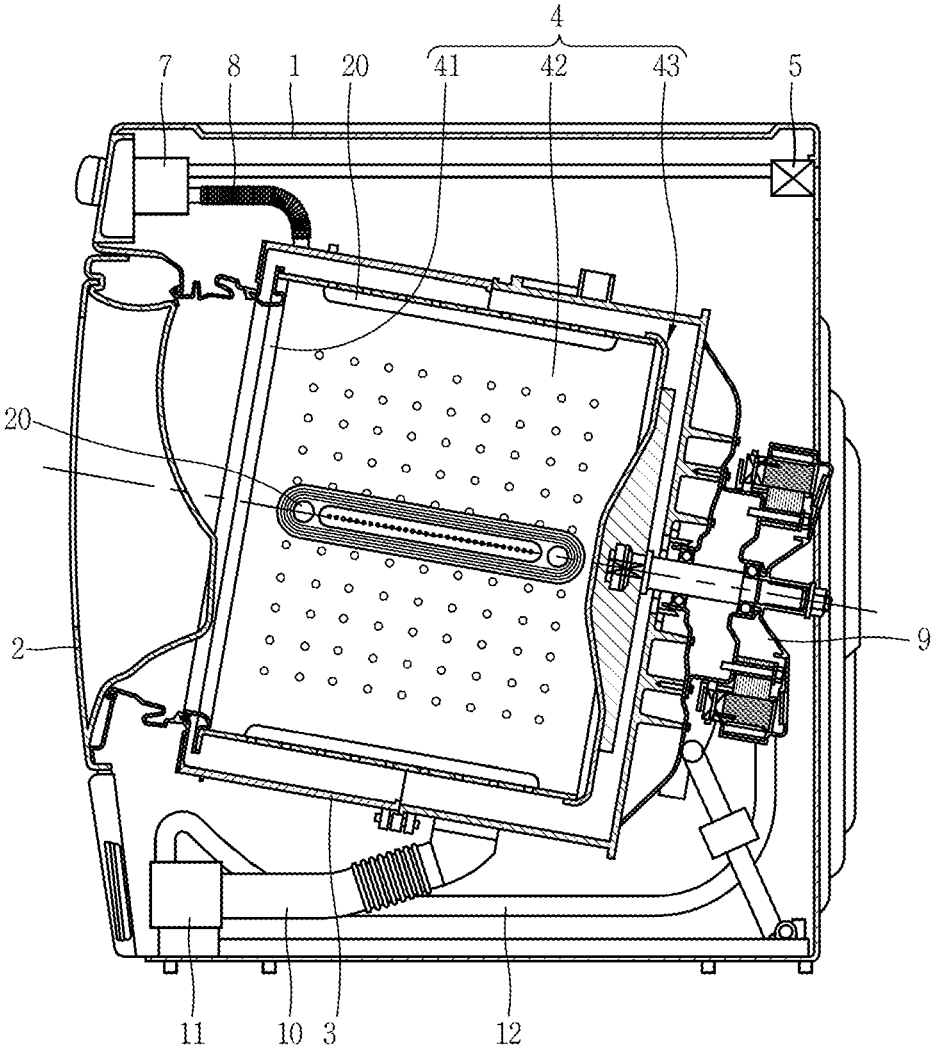
FIG. 1 is a lateral sectional view illustrating an example of a washing machine.
Figure 2:
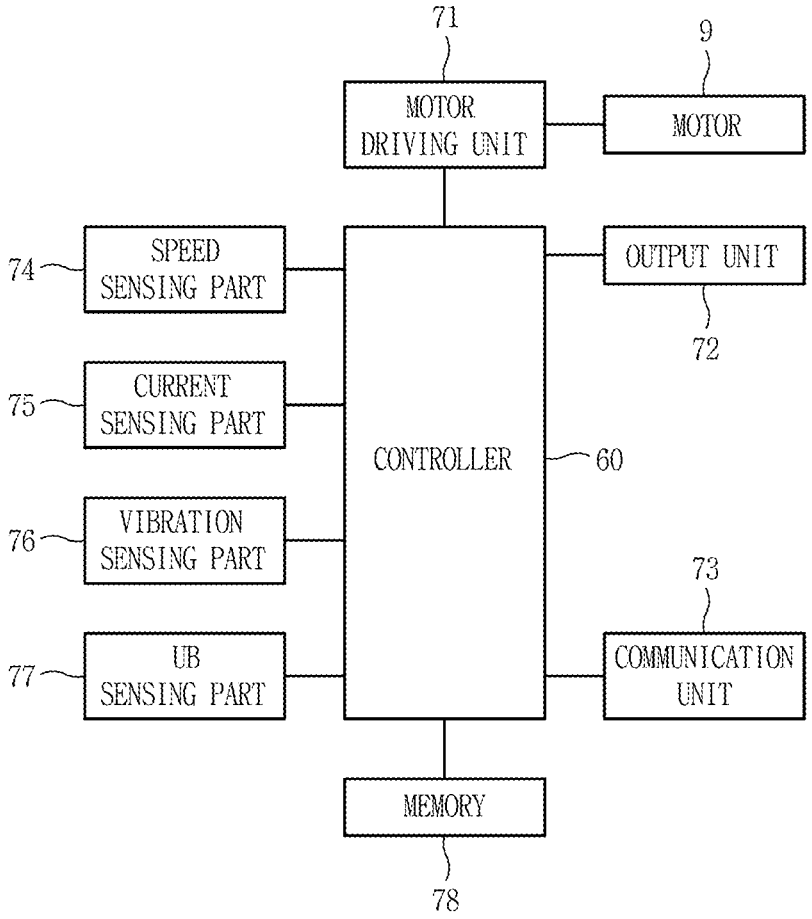
FIG. 2 is a block diagram illustrating an example of a control relationship between example components of the washing machine of FIG. 1.

FIG. 1 is a lateral sectional view of an example of a washing machine, and FIG. 2 is a block diagram illustrating an example of a control relationship between example components of the washing machine of FIG. 1.

Referring to FIG. 1, a washing machine includes a casing 1 forming an outer appearance, a water storage tank (or tub) 3 disposed in the casing 1 and configured to store wash water therein, a washing tub 4 rotatably disposed in the water storage tank 3 into which laundry is introduced, and a motor 9 configured to rotate the washing tub 4.

In some implementations, the washing tub 4 may include a front cover 41 having an opening for putting in and taking out of laundry, a cylindrical drum 42 substantially horizontally disposed so that a front end thereof is coupled to the front cover 41, and a rear cover 43 coupled to a rear end of the drum 42. A rotation shaft of the motor 9 may be connected to the rear cover 43 by passing through a rear wall of the water storage tank 3. A plurality of through holes may be formed in the drum 42 so that water is exchanged between the washing tub 4 and the water storage tank 3.

In some implementations, a lifter 20 may be provided on an inner circumferential surface of the drum 42. The lifter 20 protruding from the inner circumferential surface of the drum 42 extends long to a length direction (a forward-backward direction) of the drum 42, and a plurality of the lifters 20 may be disposed in a circumferential direction with some spacing therebetween. Laundry may be lifted up by the lifter 20 when the washing tub 4 is rotated.

In some examples, although it is not limited to this, a height of the lifter 20 protruding from the drum 42 may be 30 mm or less (or 6.0% of a drum diameter), for examples, from 10 to 20 mm. Particularly, when the height of the lifter 20 is 20 mm or less, even if the washing tub 4 is continuously rotated in one direction at approximately 80 rpm, laundry may be moved without being attached to the washing tub 4. That is, when the washing tub 4 rotates in one direction more than once, the laundry located at the lowermost position in the washing tub 4 may be lifted up to a predetermined height by the rotation of the washing tub 4 and then dropped while being separated from the washing tub 4.

The washing tub 4 rotates centered on a horizontal axis. Here, the term "horizontal" may not be limited to geometrically horizontal in the strict sense, but it may include an axis that is closer to a horizontal orientation rather than a vertical orientation with respect to a ground. For example, the rotation axis of the washing tub 4 may be inclined at a predetermined angle with respect to the horizontal axis as shown in FIG. 1. In some examples, the washing tub 4 may rotate about the horizontal axis. In some examples, the washing tub 4 may rotate about an axis inclined with respect to the horizontal axis.

A laundry inlet is formed at a front surface of the casing 1, and a door 2 for opening and closing the laundry inlet is rotatably provided in the casing 1. A water inlet valve 5, a water inlet pipe 6, and a water inlet hose 8 may be installed in the casing 1. When the water inlet valve 5 is opened for supplying water, wash water having passed through the water inlet pipe 6 may be mixed with a detergent in a dispenser 7 and then introduced into the water storage tank 3 through the water inlet hose 8.

An input port of a pump 11 is connected to the water storage tank 3 through a drain hose 10, and an outlet port of the pump 11 is connected to the drain pipe 12. The water discharged from the water storage tank 3 through the drain hose 10 is fed by the pump 11 to flow along the drain pipe 12, and is then discharged to the outside of the washing machine.

Referring to FIG. 2, a washing machine may include a controller 60 configured to control the entire operation of the washing machine, a motor driving unit 71 controlled by the controller 60, an output unit 72, a communication unit 73, a speed sensing part 74, a current sensing part 75, a vibration sensing part 76, a UB sensing part 77, and a memory 78. The memory 78 may include a non-transitory memory device.

The controller 60 may control a series of washing processes of washing, rinsing, dewatering, and drying. The controller 60 may perform washing, rinsing, dewatering, and drying according to a preset algorithm, and also control the motor driving unit 71 according to the algorithm. For example, the controller 60 may include a processor, an electric circuit, etc. In some cases, the controller 60 may include or communicate with one or more of the output unit 72, the communication unit 73, the speed sensing part 74, the current sensing part 75, the vibration sensing part 76, the UB sensing part 77, and the memory 78.

The motor driving unit 71 may control driving of the motor 9 in response to a control signal applied by the controller 60. The control signal may be a signal for controlling a target speed of the motor 9, an acceleration tilt (or acceleration), a driving time, and the like.

The motor driving unit 71 is for powering the motor 9, which may include an inverter and an inverter controller. In addition, the motor driving unit 71 may further include a converter or the like used for supplying direct current (DC) power to the inverter.

For example, when the inverter controller outputs a switching control signal of a Pulse Width Modulation (PWM) method to the inverter, then the inverter performs high switching so as to supply alternating current (AC) power of a predetermined frequency to the motor 9.

In some implementations, in controlling the motor 9 in a specific manner by the controller 60, the controller 60 may apply a control signal to the motor driving unit 71 so that the motor driving unit 71 controls the motor 9 in a specific manner based on the control signal. Here, the specific manner may include various implementations described herein.

The speed sensing part 74 detects a rotational speed of the washing tub 4. The speed sensing part 74 may detect rotational speed of a rotor of the motor 9. When a planetary gear train that rotates the washing tub 4 by changing a revolution ratio of the motor 9 is provided, the rotational speed of the washing tub 4 may be a value converted to the rotational speed of the rotor sensed by the speed sensing part 74 in consideration of a deceleration or acceleration ratio of the planetary gear train.

The controller 60 may control the motor driving unit 71 so that the motor 9 follows a preset target speed by giving feedback on a rotational speed of the washing tub received from the speed sensing part 74. In other words, the controller 60 may control the motor 9 so that the rotational speed of the washing tub reaches the target speed.

The current sensing part 75 detects an electric current applied to the motor 9 (or output current flowing to the motor 9) to transmit the sensed current to the controller 60. The controller 60 may detect the laundry amount and laundry-tangled degree using the received current.

In some implementations, values of the current include values obtained in a process in which the washing tub 4 is accelerated toward the target speed (or a process in which the motor 9 is accelerated toward the preset target speed).

When rotation of the motor 9 is controlled by vector control based on a torque current and a magnetic flux current, the current may be a torque axis (q-axis) component flowing to a motor circuit, namely, a torque current (Iq).

The vibration sensing part 76 detects vibration in the water storage tank 3 (or a washing machine) generated by rotation of the washing tub 4 in which laundry is accommodated.

A washing machine may include a vibration sensor (or a vibration measurement sensor). The vibration sensor may be provided at one point in the washing machine, e.g., at one point of the water storage tank 3. Alternatively, the vibration sensor may be provided in the vibration sensing part 76.

The vibration sensing part 76 may receive a vibration value (or a vibration signal) measured by the vibration sensor to transmit the vibration value to the controller 60. The vibration sensing part 76 may also calculate a vibration value (or intensity of vibration) of the water storage tank 3 (or washing machine) using the vibration signal measured by the vibration sensor.

In some implementations, the washing machine may further include a UB sensing part 77. The UB sensing part 77 may detect an amount of eccentricity (an amount of shaking) of the washing tub 4, that is, unbalance (UB) of the washing tub 4. The UB sensing part 77 may calculate a UB value that numerically indicates shaking of the washing tub 4.

The UB sensing part 77 will be described later in more detail.

The speed sensing part 74, current sensing part 75, vibration sensing part 76, and UB sensing part 77 provided in the washing machine according to the present disclosure may also be referred to as a 'sensing unit', and be understood as a concept included in the sensing unit.

In some examples, the sensing unit may measure (calculate) a plurality of types of data including at least one of the rotational speed value (or speed value) of the washing tub 4 measured by the speed sensing part 74, the current value applied to the motor 9, which is measured by the current sensing part 75, the vibration value of the water storage tank 3 measured by the vibration sensing part 76, and the shaking value (UB value) of the washing tub 4 measured by the UB sensing part 77.

The plurality of types of data may include data related to unbalance (UB) of the washing tub 4, data for measuring UB of the washing tub 4, data obtained by rotation of the washing tub 4, and the like. The plurality of types of data may be used to control the washing tub 4 during the dewatering stroke.

For example, the plurality of types of data may be input as an input value of an artificial neural network learned through machine learning to calculate the laundry-tangled degree as an output value.

In some implementations, in the drawing, the speed sensing part 74, the current sensing part 75, the vibration sensing part 76, and the UB sensing part 77 are separately provided from the controller 60, but the present disclosure is not limited thereto.

At least one of the speed sensing part 74, the current sensing part 75, the vibration sensing part 76, and the UB sensing part 77 may be provided in the controller 60. In this case, functions/operation/control methods performed by the speed sensing part 74, the current sensing part 75, the vibration sensing part 76, and the UB sensing part 77 may be performed by the controller 60.

It will be understood that when the vibration sensing part 76 is included in the controller 60 or is performed by the controller 60, the vibration sensor is separately provided at one point of the washing machine, not included in the vibration sensing part 76.

The controller 60 may include a learning module for laundry amount/laundry-tangled degree, and a recognition module for a laundry amount/laundry-tangled degree. The learning module for the laundry amount/laundry-tangled degree uses at least one of the plurality of types of data detected by the speed sensing part 74, the current sensing part 75, the vibration sensing part 76, and the UB sensing part 77 for machine learning. Through this machine learning, the learning module for laundry amount/laundry-tangled degree may update a pre-learned artificial neural network (ANN) stored in the memory 78.

A learning method of the learning module for laundry amount/laundry-tangled degree may include at least one of unsupervised learning and supervised learning.

The recognition module for laundry amount/laundry-tangled degree may determine a level of the laundry amount and a level of the laundry-tangled degree based on data (or ANN) learned by the learning module for the laundry amount/laundry-tangled degree.

Determining the laundry amount may be a task of classifying the laundry placed in the washing tub 4 into a plurality of preset levels according to weight (load).

Determining the laundry-tangled degree may be a task of classifying the laundry placed in the washing tub 4 into a plurality of preset levels (or steps, classes) according to a degree of tangling.

The recognition module laundry amount/laundry-tangled degree may determine a level of laundry amount and a class of laundry-tangled degree (that is, a laundry-tangled degree according to a laundry amount) for the laundry placed in the washing tub 4 based on the plurality of types of data obtained from at least one of the speed sensing part 74, the current sensing part 75, the vibration sensing part 76, and the UB sensing part 77.

The above-described learning module and recognition module for laundry amount/laundry-tangled degree and recognition module for laundry amount/laundry-tangled degree may be independent components, and be included in the controller 60.

Also, functions/operation/control methods performed by the learning module for laundry amount/laundry-tangled degree and recognition module for laundry amount/laundry-tangled degree may be performed by the controller 60. Hereinafter, for convenience of explanation, description will be given under assumption that the controller 60 performs the functions/operation/control methods of the learning module for laundry amount/laundry-tangled degree and recognition module for laundry amount/laundry-tangled degree.

The output unit 72 may output various information related to a washing machine. For example, the output unit 72 outputs an operating state of the washing machine. The output unit 72 may be an image output device for outputting a visual display such as a liquid crystal display (LCD) or a light emitting device display (LED), or an acoustic output device for outputting sound such as a buzzer. The output unit 72, controlled by the controller 60, may output information of the laundry amount or the laundry-tangled degree.

A programmed ANN, a current pattern according to a laundry amount and/or a laundry-tangled degree, a database (DB) constructed by machine learning based on the current pattern, a machine learning algorithm, current values detected by the current sensing part 75, average values of the detected current values, values obtained by processing the average values according to a parsing rule, and data transmitted and received through the communication unit 73, and the like may be saved in the memory 78.

In addition, data such as all sorts of control data for controlling the entire operation of the washing machine, data of washing settings input by the user, data of wash time calculated according to the washing settings, data of wash courses, data for determining a washing machine error, and the like may be saved in the memory 78.

The communication unit 73 may communicate with a server connected to a network. The communication unit 73 may include at least one communication module such as an Internet module, a mobile communication module, etc. The communication unit 73 may receive various types of data such as learning data and algorithm updates from the server.

The controller 60 may update the memory 78 by processing various types of data received through the communication unit 73. For example, in case data input through the communication unit 73 is related to an operation program update, which is pre-stored in the memory 78, the controller 60 may update the memory 78 using the update data. When the input data is about a new operation program, the controller 60 may additionally save the new operation program in the memory 78.

Machine learning means that a computer learns from data and solves a problem without being explicitly instructed logic by a person.

Deep learning is an artificial intelligence technology, which is based on an ANN for constructing artificial intelligence so that a computer thinks and learns like people without having to teach it. The ANN may be implemented in a software form or in a hardware form such as a chip.

For example, a washing machine, based on the machine learning, may figure out properties of the laundry (fabric) (hereinafter, referred to as properties of fabric) introduced into the washing tub 4 by processing current values sensed by the current sensing part 75.

These properties of fabric may include the laundry amount, laundry-tangled degree, and fabric type.

The controller 60 may determine the laundry-tangled degree according to the laundry amount based on machine learning. For example, the controller 60 may measure the laundry amount to determine one category among the pre-classified categories based on the laundry-tangled degree. The laundry-tangled degree represents a degree to which the laundry (fabric) items placed in the washing tub 4 are tangled (or twisted) with each other and an extent to which one laundry (fabric) item is evenly loaded, or tangled, which may be classified into the preset laundry-tangled levels (steps).

For example, the lower the degree of tangled laundry, the less the laundry is tangled (that is laundry is slightly tangled), and the higher the degree of tangled laundry, the more the laundry is tangled (that is, laundry is severely tangled).

Such a laundry-tangled degree may be variously defined or classified according to various types of laundry (fabric texture) in the washing tub 4, and may vary depending on a combination and properties of various types of the laundry. In case, the laundry type is the same, the laundry-tangled degree may be determined or varied depending on its material, moisture content, volume difference, and laundry type.

The laundry-tangled degree may be understood as a different concept from the fabric type defined based on various factors such as a fabric material, a degree of softness (e.g., soft/hard fabric), ability of the fabric to contain water (moisture content), a volume difference between dry fabric and wet fabric. The controller 60 may detect the laundry amount by using a current value, which is currently detected by the current sensing part 75, as input data of the ANN pre-learned by machine learning until the target speed is reached.

In addition, the controller 60 may determine (predict, estimate, calculate) various information related to unbalance of the washing tub 4 according to the present disclosure using the ANN learned through machine learning.

For example, the controller 60 may sort (determine) the laundry-tangled degree by inputting the plurality of types of data as an input value of the ANN. Thereafter, the controller 60 may change the allowable UB value, a criterion for interrupting (initializing) the dewatering process based on the determined laundry-tangled degree.

Hereinafter, the UB sensing part 77 for measuring unbalance of the washing tub 4 according to the present disclosure will be described in more detail.

The UB sensing part 77 may measure unbalance of the washing tub 4 generated when the washing tub 4 in which laundry is accommodated rotates. Here, unbalance of the washing tub 4 may include shaking of the washing tub 4 or a shaking value (or a degree of shaking) of the washing tub 4.

The UB sensing part 77 may measure (calculate) the shaking value (or degree of shaking) of the washing tub 4 (or drum). Here, the shaking value of the washing tub 4 may be named as a UB value, a UB amount, an unbalance value, an unbalance amount, or an eccentricity amount.

In this specification, unbalance (UB) may include the amount of eccentricity of the washing tub 4, that is, unbalance of the washing tub 4 or shaking of the washing tub 4, which may be caused by uneven arrangement or distribution of the laundry.

The UB value is for indicating an intensity (or a degree) of shaking of the washing tub, which may be calculated (computed) based on the amount of rotational speed variations of the washing tub 4 (or motor 9), or the amount of acceleration variations of the washing tub 4 (or the motor 9).

For example, the UB sensing part 77 may calculate the UB value by receiving the rotational speed of the washing tub 4 (or motor 9) measured by the speed sensing part 74 and using the amount of variations in the received rotational speed. Here, the amount of rotational speed variations may include, for example, a difference in rotational speed measured at predetermined time intervals, a difference in rotational speed measured at each time when the washing tub 4 is rotated by a predetermined angle, or a difference between the maximum rotational speed and the minimum rotational speed.

For example, the UB sensing part 77 may measure the rotational speed of the washing tub 4, measured by the speed sensing part 74, at each predetermined angle to calculate the UB value through a difference in the measured rotational speed. Thereafter, the UB sensing part 77 may calculate the UB value by using a value obtained by subtracting the minimum rotational speed from the maximum rotational speed in the measured rotational speed values.

As another example, the UB sensing part 77 may calculate the UB value (UB (k)) based on the formula 1 to 3 below by using rotational speed (e.g., rotational speed (RPM) at every 30 degrees) values measured at predetermined angles.

$$a_k=(v_k+v_{k-1}+\ldots+v_{k-5})-(v_{k-6}+v_{k-7}+\ldots+v_{k-11}) \quad \text{Formula 1:}$$

$$v_k=v_{k+12} \quad \text{Formula 2:}$$

$$UB(k)=\max(a_k,a_{k-1},\ldots,a_{k-11})-\min(a_k,a_{k-1},\ldots,a_{k-11}) \quad \text{Formula 3:}$$

where $v_k$ to $v_{k-11}$ denote rotational speeds measured at every predetermined angle (e.g., every 30 degrees), and k is an integer.

Accordingly, the UB value becomes larger as shaking (or vibration) of the washing tub 4 during the rotation of the washing tub is increased due to uneven arrangement (unbalance) of the laundry in the washing tub 4.

As another example, the UB value may include a predetermined value proportional to the amount of rotational speed variations (a value obtained by subtracting the minimum rotational speed from the maximum rotational speed).

The UB value may be calculated based on the rotational speed of the washing tub, a current value applied to the motor, or a vibration value of the water storage tank 3 measured by the vibration sensor.

In some implementations, the UB value may be defined as various values measured by unbalance of the washing tub 4. In this specification, it is assumed that the UB value is defined based on rotational speed (RPM) fluctuations of the washing tub 4 detected when the washing tub 4 rotates.

For example, in case laundry is placed to be concentrated in one side of the washing tub 4 or laundry is severely tangled, unbalance is increased (that is, unbalance becomes severe), causing the washing tub to shake or vibrate a lot while rotating. And the UB value becomes larger accordingly.

As the washing tub shaking becomes severe (as the UB value of the washing tub becomes larger), a large current load is applied to the motor 9 for rotating the washing tub 4 at high-speed during the dewatering stroke, causing huge energy consumption and noise.

When laundry is evenly distributed in the washing tub 4 or laundry is slightly tangled, unbalance is reduced. Accordingly, even if the washing tub is rotated at high speed, shaking of the washing tub becomes small, and the UB value becomes smaller accordingly.

In a washing machine according to the present disclosure, a laundry balancing process (laundry diffusion process) may be performed during the dewatering stroke by decreasing the UB value so as to reduce energy consumption and noise.

The laundry balancing process refers to a process for evenly loading the laundry in the washing tub 4 or for untangling the laundry. Unbalance of the washing tub 4 is reduced when the laundry is evenly loaded (distributed) or the tangled laundry gets untangled.

The laundry balancing process may include a process in which laundry is lifted up by a predetermined height and then dropped in order to evenly load or distribute the laundry. For this reason, the laundry balancing process may be performed during a dewatering operation section or period (for example, 80 RPM or lower section) in which the laundry is rotated without being attached to the washing tub 4 so as to be lifted up to a predetermined height then fall. As the laundry is lifted up to a predetermined height and then dropped, the tangled laundry gets untangled by impact of the drop. Accordingly, unbalance is reduced as the laundry becomes evenly loaded.

In some implementations, rotation of the washing tub 4 may be stopped during the dewatering process (dewatering stroke) when a measured (detected) unbalance (UB) value, generated by the rotation of the washing tub, exceeds the preset allowable UB value (that is, when the UB value exceeds the preset allowable UB value).

Exceeding the preset allowable UB value means that shaking of the washing tub 4 is generated more than a reference vibration value as laundry in the washing tub 4 is unevenly distributed. In this case, when rotating the washing tub 4 at a high RPM, noise is generated and a large current load is consumed.

The controller 60 according to the present disclosure may interrupt (initialize) the dewatering process when the UB value exceeds the preset allowable UB value. For example, the controller 60 may stop rotating the washing tub for a period of time based on the UB value exceeding the allowable UB value, and restart rotating the washing tub based on an elapse of the period of time.

In some examples, interrupting the dewatering process may include initializing the dewatering process so that the dewatering process is restarted from the beginning (or the dewatering process is started again from a section after detecting a dewatered laundry amount), the rotation of the washing tub 4 is stopped, interrupted, or a combination thereof.

The preset allowable UB value may include a preset reference value, which is a criterion for stopping rotation of the washing tub (initializing the dewatering process) during the dewatering process.

The preset allowable UB value may also be referred to as an allowable UB value limit, a reference UB value, a set UB value, or the like.

The preset allowable UB value may be set for each dewatering operation section or period (first to $n^{th}$ sections), as shown in FIG. 7A.

The dewatering operation section (first to $n^{th}$ sections) is a plurality of sections included in the dewatering process. It may include at least one section among a rotational speed increase section, a rotational speed maintaining section, and a rotational speed reduction section, for example, a section in which rotation of the washing tub 4 is maintained at first speed, a section in which rotation of the washing tub 4 is accelerated to second speed from the first speed, a section in which rotation of the washing tub 4 is maintained at the second speed, a section in which rotation of the washing tub 4 is decelerated to third speed from the second speed, a section in which rotation of the washing tub 4 is maintained at the third speed.

In some implementations, the dewatering operation sections may include sections in which the rotational speed of the washing tub gradually increases by repeating maintenance sections and acceleration sections.

In the related art, as illustrated in FIG. 7A, a fixed allowable UB value set for each laundry amount is used. In other words, only a fixed allowable UB value is used for one laundry-amount level according to each dewatering operation section regardless of a laundry-tangled degree.

In addition, in the related art, even in the case of laundry having a high degree of tangling, the allowable UB value is set to be somewhat larger in order to satisfy (meet) an entry time for a high-speed dewatering operation section.

In addition, unbalance may be different even in the same laundry amount when the laundry-tangled degree is different.

Accordingly, even in the case of laundry having a low degree of tangling (in the case of a practical load with good balancing), a fixed allowable UB value is set to be large. As a result, the laundry enters the high-speed dewatering operation section without being evenly distributed since the fixed allowable UB value is satisfied. In this case, noise or abnormal vibration in the high-speed dewatering operation section is highly likely to occur.

Hereinafter, a washing machine capable of setting an optimized allowable UB value which takes a laundry amount and laundry-tangled degree into consideration will be described in detail with reference to the accompanying drawings.

Figure 3:
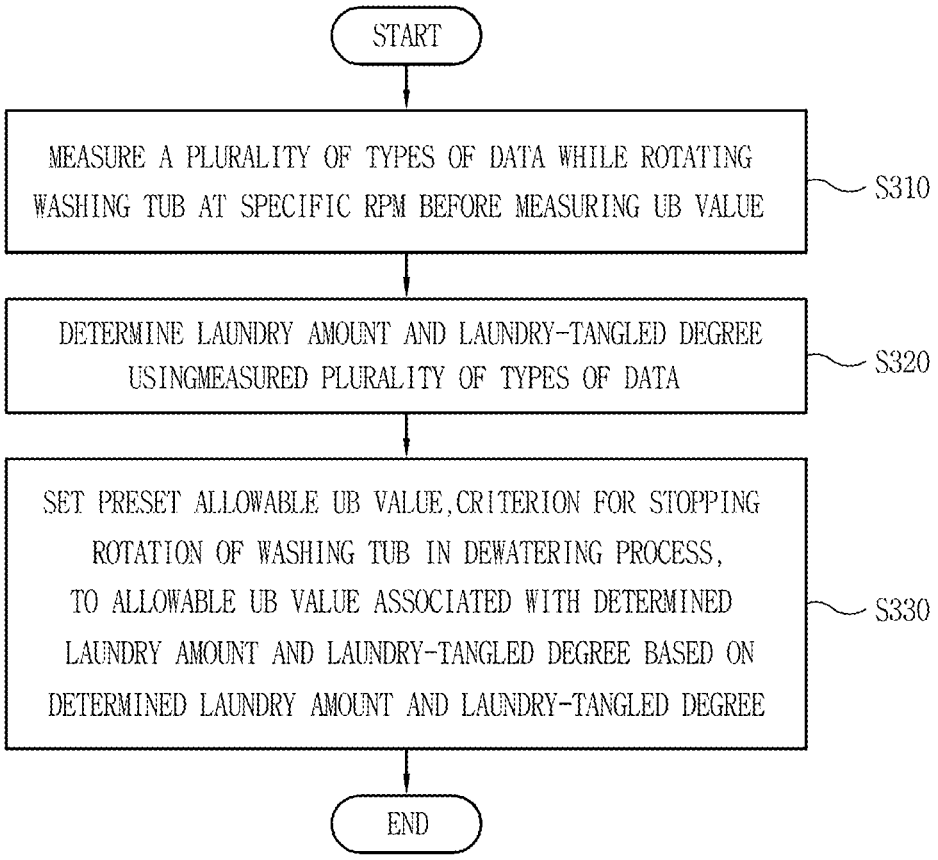
FIG. 3 is a flowchart illustrating an example control method.
Figure 4:
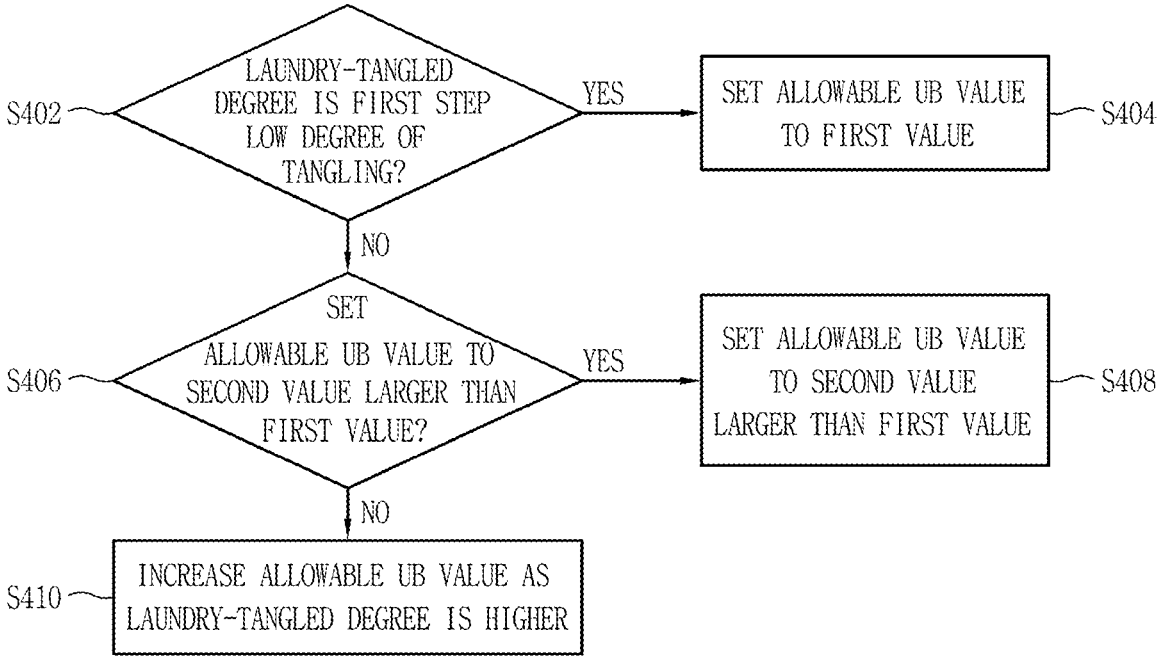
FIG. 4 is a flowchart illustrating a detailed control method of FIG. 3.
Figure 5:
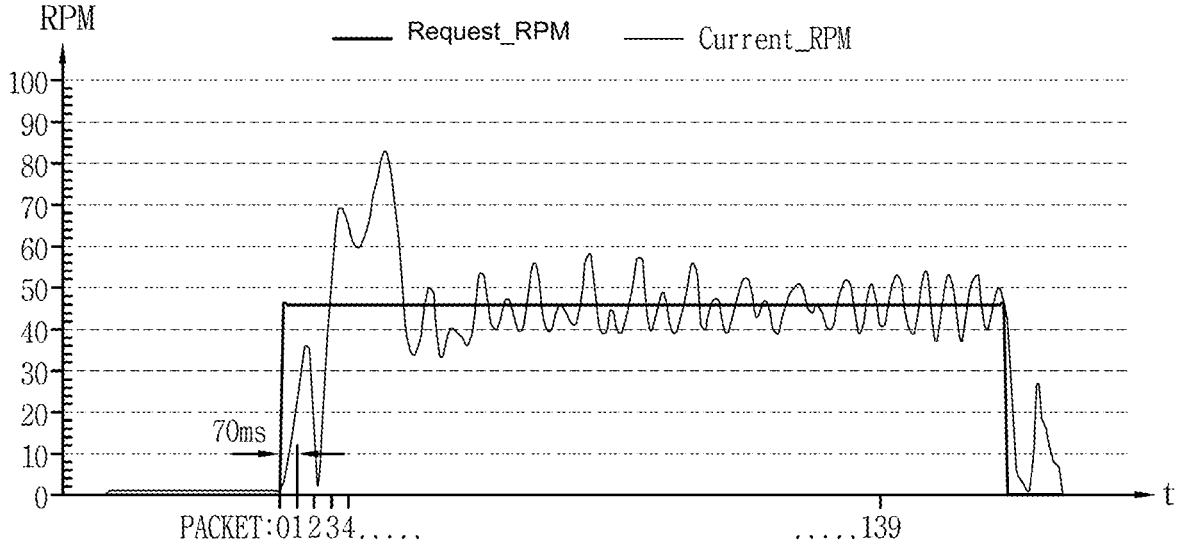
FIGS. 5 and 6 are conceptual views illustrating the control methods of FIGS. 3 and 4.
Figure 6:
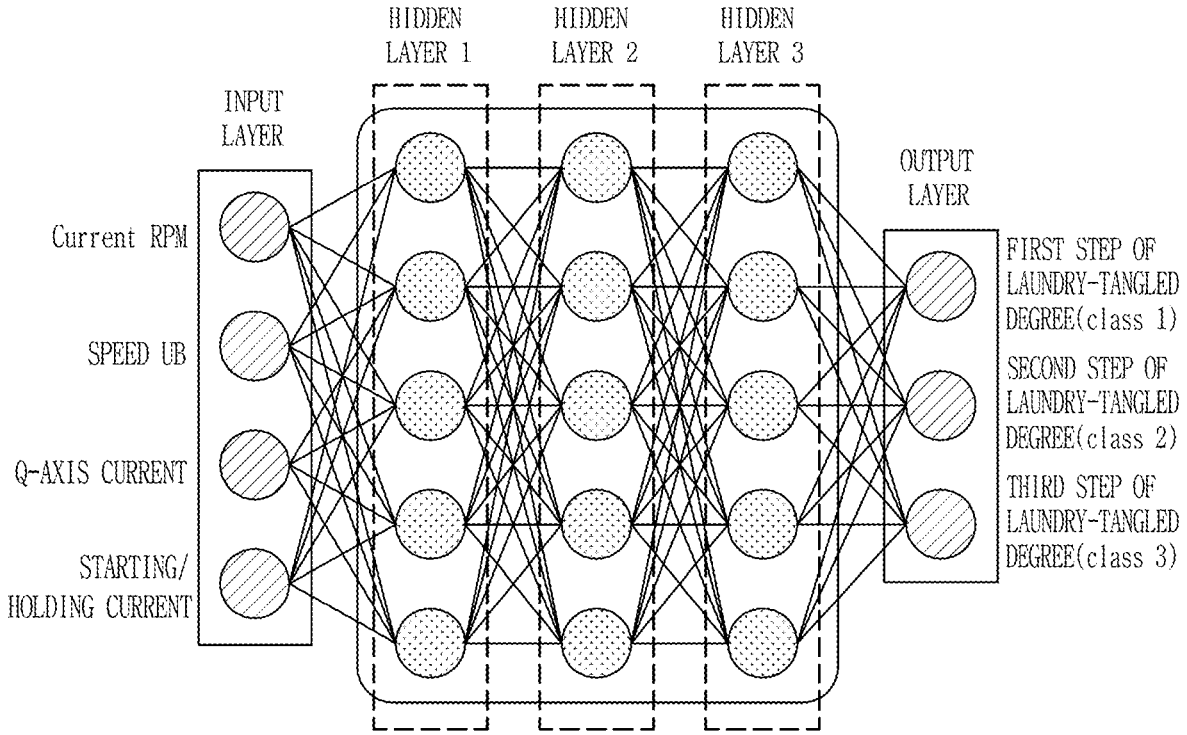

FIG. 3 is a flowchart illustrating an example control method according to the present disclosure, and FIG. 4 is a flowchart illustrating an example control method of FIG. 3. FIGS. 5 and 6 are conceptual views illustrating the control methods of FIGS. 3 and 4. FIGS. 7A and 7B illustrate examples of UB tables.

In some implementations, the washing machine may include a washing tub 4 configured to accommodate laundry therein, a motor 9 configured to rotate the washing tub, and a controller 60 configured to control the motor to stop rotation of the washing tub when a measured (detected) unbalance (UB) value, generated by the rotation of the washing tub during a dewatering process (dewatering stroke), exceeds a preset allowable UB value (that is, when a UB value exceeds a preset allowable UB value).

In some implementations, the controller 60 may determine the laundry-tangled degree using a plurality of types of data (e.g., before the dewatering stroke or in a rinsing stoke (rinsing process) before measuring the UB value.

In addition, the controller 60 may modify (change) a preset allowable UB value, which is a criterion for interrupting (initializing) the dewatering process (or serving as a criterion for stopping rotation of the washing tub in the dewatering process) based on the determined laundry amount and laundry-tangled degree.

Specifically, the controller 60 may set the preset UB value to an allowable UB value associated with the determined laundry amount and laundry-tangled degree based on the determined laundry amount and laundry-tangled degree.

The washing machine has a technical feature in that the allowable UB value is set by using a more segmented UB table according to the laundry-tangled degree as well as the laundry amount.

In some cases, as shown in FIG. 7A, a fixed UB table may be used in which the allowable UB value is only set (linked) according to the laundry amount.

In some implementations, as shown in FIG. 7B, a plurality of laundry-tangled degrees is more segmented for each laundry amount, and an active UB table including the allowable UB value that the laundry amount and the laundry-tangled degree are linked together. Accordingly, the allowable UB value, a criterion for initializing (interrupting) the dewatering process, can be determined based on the detected laundry-amount and laundry-tangled degree.

In other words, unlike the related art that uses the fixed UB table, the present disclosure can provide a washing machine capable of setting the allowable UB value which takes the laundry-tangled degree as well as the laundry amount into consideration by using the active UB table, which is further segmented by the laundry-tangled degree according to each laundry amount.

In this specification, changing the preset allowable UB value (or allowable UB value) should be understood that an allowable UB value is applied differently based on the detected laundry-tangled degree, which is different even in the same laundry amount for each dewatering process. That is, it should be noted that changing the preset allowable UB value (or allowable UB value) in this specification does not mean to change the allowable UB value itself associated with a specific laundry amount and laundry-tangled degree.

In this specification, it should be understood that changing the preset allowable UB value is to apply (use, set) a different allowable UB value associated with a differently measured laundry amount and laundry-tangled degree whenever a laundry amount and laundry-tangled degree are measured differently.

Referring to FIG. 3, the controller 60 may measure the plurality of types of data while rotating the washing tub at a specific rotational speed before measuring the UB value (before entering the dewatering process, during the rinsing process, or before measuring the UB value during the dewatering process) (S310).

Here, before measuring the UB value may be before entering the dewatering process or during the rinsing process (or rinsing stroke) or before a time point when the UB value included in the dewatering process is measured.

In addition, the specific rotational speed is rotational speed at which a tumbling motion is performed. For example, the specific rotational speed may be somewhere between 40 and 50 RPM.

The tumbling motion allows the motor 9 to rotate the washing tub 4 in one direction so that laundry placed in an inner surface of the drum 42 is controlled to drop to the lowest point of the drum 42 at a position of about 90 to 110 degrees in a rotational direction of the washing tub 4. In the tumbling motion, the motor 9 rotates the washing tub 4 in one direction, and when the laundry rotates clockwise, the laundry moves from the third quadrant of the drum to a part of the second quadrant of the drum, and drops to the lowest point, and is then lifted up again to fall. Such series are repeated.

The controller 60 may measure the plurality of types of data while rotating the washing tub at the specific rotational speed (for example, 46 RPM) so that laundry is lifted up by a predetermined height and then dropped during the rinsing process performed before the dewatering process.

In other words, the controller 60 may measure the plurality of types of data while rotating the washing tub 4 at the specific rotational speed so as to perform the tumbling motion during the rinsing process.

The plurality of types of data may include at least one of current rotational speed (Current RPM), speed UB (or UB value or virtual vibration amount), a q-axis current (Iq), starting/holding currents, information of laundry-amount level, and a vibration value.

The plurality of types of data may be data related to the rotation of the washing tub. For example, the plurality of types of data may be measured (calculated) by at least one of the speed sensing part 74, the current sensing part 75, the vibration sensing part 76, and the UB sensing part 77.

The plurality of types of data may include a current RPM value (or current speed value) of the washing tub 4 measured by the speed sensing part 74, a current value applied to the motor 9 (q-axis current and starting/holding currents) measured by the current sensing part 75, a vibration value of the water storage tank 3 measured by the vibration sensing part 76, and a shaking value (UB value, speed UB) of the washing tub 4 measured by the UB sensing part 77.

The current RPM, as illustrated in FIG. 5, may include actually measured rotational speed (Current_RPM) of the washing tub 4, not the target rotational speed (Request_RPM).

As illustrated in FIG. 5, although a control signal is applied to the motor driving unit 71 so as to rotate the washing tub 4 at the target rotational speed, unbalance is generated when the laundry is unevenly placed (distributed) in the washing tub 4, causing RPM fluctuations of the washing tub 4.

The current rotational speed (current RPM) may be data obtained by sequentially summing a predetermined number (for example, 10) of rotational speed values measured at predetermined time intervals (for example, 70 ms). However, the present disclosure is not limited to this, and the current RPM may also be an average value of the rotational speed values measured at predetermined time intervals.

The speed UB (UB value) may be data obtained by sequentially summing a predetermined number (for example, 5) of speed UB values measured at predetermined time intervals (for example, 70 ms). Similarly, the speed UB may be an average value of the UB values (or sum data) measured at predetermined time intervals.

The current RPM and the speed UB may be measured by the speed sensing part 74.

The q-axis current (Iq) represents a torque current (Iq) value (or the sum data of current values measured at each predetermined time intervals or the average value) corresponding to a torque axis (q-axis) component among the currents applied to the motor.

The starting current may include a current applied to accelerate the washing tub 4 to rotate a specific rotational speed (for example, 46 RPM), and the holding current may include a current applied to maintain a specific rotational speed after the washing tub 4 reaching it.

The starting/holding currents are generated after a predetermined time period has passed since the start, and may be one representative value. The starting/holding currents may be measured (calculated) based on the measured q-axis current.

The q-axis current and the starting/holding currents may be measured by the current sensing part 75.

In addition, when a vibration sensor is provided in a washing machine, the controller 60 may measure a vibration value of the water storage tank 3. Likewise, the vibration value may include a vibration displacement value of the water storage tank, and may include the sum data (or the average value) of the vibration values measured at predetermined time intervals.

In other words, the controller 60 according to the present disclosure may not only measure data at a specific moment but also use the sum data (or the average value) measured at predetermined time periods as data.

Further, the controller 60 may measure a plurality of different types of data, not just use one type of data.

Referring back to FIG. 3, the controller 60 may determine the laundry amount and laundry-tangled degree using the plurality of types of data measured (S320).

For detecting the laundry amount, the controller 60 may input at least one of the plurality types of data (for example, a q-axis current) into the pre-learned ANN through machine learning to output (detect) the laundry amount as an output value.

In addition, the controller 60 may determine one level among the plurality of laundry-amount levels using the current value detected by the current sensing part.

A washing machine according to the present disclosure may detect the laundry amount by applying at least one of the technologies for detecting all types of laundry amounts developed to date. The technology for detecting the laundry amount is a general technology, thus more detailed description thereof will be omitted.

The controller 60 may detect the laundry amount at various points of time. For example, the controller 60 may detect the laundry amount when measurement of the plurality of types of data is completed, or may detect the laundry amount before starting measurement of the plurality of types of data.

Also, the controller 60 may detect the laundry amount before entering the dewatering stroke (process), which is after completely draining water during the rinsing stroke.

In addition, the controller 60 may sense the laundry amount together when detecting (calculating) the laundry-tangled degree.

A point of time for detecting the laundry amount may be set differently and be determined or changed according to user settings.

In some implementations, the point of time at which the laundry amount and laundry-tangled degree are detected may be before the UB value is measured (that is, before the dewatering process, after finishing the rinsing process, or before initially measuring the UB value during the dewatering process, etc.). This is to determine the laundry amount and laundry-tangled degree before the UB value is measured, and to set the preset allowable UB value, which is a comparison target (criterion) for the UB value based on the determined laundry amount and laundry-tangled degree.

The controller 60 may input the measured plurality of types of data as an input value of a pre-learned ANN to output the laundry-tangled degree of as a result value.

Specifically, the controller 60 may determine any one laundry-tangled degree among the plurality of classified steps (for example, a first step (level) (class 1), a second step (level) (class 2), and a third step (level) (class 3).

Referring to FIG. 6, the controller 60 may determine (detect, judge, and calculate) the laundry-tangled degree by using the plurality of types of data (for example, current RPM, speed UB, q-axis current, starting/holding currents) measured in the rinsing stroke as input data (input data, input layer) of the ANN pre-learned by machine learning.

The controller 60 may input the measured plurality of types of data as an input value of the pre-learned ANN to output the laundry-tangled degree as a result value.

In some implementations, the controller 60 may determine any one laundry-tangled degree among the plurality of classified laundry-tangled steps (a first step (class 1), a second step (class 2), a third step (class 3) through the pre-learned ANN.

In some implementations, the present disclosure may include an ANN for calculating the laundry-tangled degree as a result value. Information of the ANN may be pre-stored in the memory 78 or the controller 60.

FIG. 6 is a schematic view illustrating one example of the ANN.

Deep Learning, a class of machine learning, may include learning deep down to multi-levels based on data.

Deep learning may represent a set (collection) of machine learning algorithms that extract key data from multiple data by going through hidden layers in order.

A deep learning structure may include an ANN. For example, the deep learning structure may include a Deep Neural Network (DNN) such as a Convolutional Neural Network (CNN), a Recurrent Neural Network (RNN), and a Deep Belief Network (DBN).

Referring to FIG. 6, the ANN may include an input layer, hidden layers, and an output layer. Having multiple hidden layers is referred to as a DNN. Each layer has a plurality of nodes, and each layer is connected to the next layer. Nodes may be interconnected with weights.

An output from any node belonged to a first hidden layer (Hidden Layer 1) may be input to at least one node belonged to a second hidden layer (Hidden Layer 2). In this case, an input of each node may be a value obtained by applying a weight to a node of the previous layer. The weight may include link strength between nodes. The deep learning process may be seen as a process of finding a proper weight.

The ANN employed in the washing machine may include the DNN that is learned through supervised learning using the plurality of types of data (current RPM, speed UB, q-axis current, and starting/holding currents) as input data and the laundry-tangled degree measured by experiments as result data.

The supervised learning may refer to one method of machine learning for deriving a function from training data.

The ANN according to the present disclosure may be a DNN that hidden layers are learned by experimentally measuring the laundry-tangled degree for each of a plurality of types of data, and inputting each of the plurality of types of data as input data and the laundry-tangled degree measured for each of the plurality of types of data as a result value. Here, learning the hidden layers may include adjusting (updating) the weights of inter-node connection lines included in the hidden layers.

Using this ANN, the controller 60 according to the present disclosure may calculate a plurality of types of data at a specific point of time (time point), set the plurality of types of data as an input value of the ANN to determine (predict, extract, calculate, judge, estimate) the laundry-tangled degree.

The controller 60 may perform learning by using the plurality of types of data corresponding to the current RPM, speed UB, q-axis current, and starting/holding currents as training data.

Also, the present disclosure is not limited to this, the controller 60 may use a vibration value and laundry amount as additional training data, and use the vibration value and laundry amount as an input value.

In addition, the controller 60 may update a DNN structure such as weight, bias, and the like whenever detecting or determining the laundry-tangled degree by adding the determined results and plurality of types of data input at that time to a database. Also, the controller 60 may update the DNN structure such as weight and the like by performing a supervised learning process using training data after a predetermined number of training data is obtained.

The controller 60 may input the plurality of types of data as an input value of the pre-learned ANN to output (determine, detect) the laundry-tangled degree as an output value.

Referring back to FIG. 3, the controller 60, based on the determined laundry amount and laundry-tangled degree, may set (change) the preset allowable UB value, a criterion for stopping rotation of the washing tub during the dewatering process (that is, a criterion for interrupting (initializing the dewatering process), to an allowable UB value associated with the determined laundry amount and laundry-tangled degree (S330).

The controller 60 may control the washing tub 4 to stop rotation of the washing tub 4 when the UB value, generated by rotation of the washing tub in the dewatering process, exceeds the preset allowable UB value (e.g., when the detected UB value is larger than the preset allowable UB value). That is, stopping rotation of the washing tub may be to initialize (interrupt) the dewatering process so as to restart or re-run the dewatering process from the beginning (or restart from a section after detecting the laundry amount), or interrupt the rotation of the washing tub 4.

The controller 60 may determine the laundry-tangled degree using the plurality of types of data measured while rotating the washing tub 4 at specific rotational speed before entering the dewatering process (or before measuring the UB value), and change the preset allowable UB value based on the determined laundry-tangled degree.

In some implementations, the laundry-tangled degree may be determined by the plurality of types of data measured while rotating the washing tub 4 at the specific rotational speed during the rinsing process, and the pre-learned ANN through machine learning.

The controller 60 may differently apply the preset allowable UB value, which is a criterion for stopping rotation of the washing tub in the dewatering process, based on the determined laundry amount and laundry-tangled degree.

Hereinafter, it is assumed that the determined laundry level is a fourth level (Level 4).

For example, referring to FIG. 4, the controller 60 may set the preset allowable UB value to a first value (S404) when the laundry-tangled degree is determined as a first step (class 1) (S402).

In addition, when the laundry-tangled degree is determined as a second step (class 2) (S406), which is higher than the first step, the controller 60 may set the preset allowable UB value to a second value, which is larger than the first value (S408).

Further, the controller 60 may increase the preset allowable UB value as the laundry-tangled degree is higher (S410). However, the controller 60 may not increase the allowable UB value above an allowable UB value limit (that is, the controller increases the allowable UB value within the allowable UB value limit).

The first value may be a first allowable UB value associated with the fourth level of laundry amount and the first step (class) of laundry-tangled degree, and the second value may be a second allowable UB value associated with the fourth level of laundry amount and the second step (class) of laundry-tangled degree.

For example, when the laundry-tangled degree determined by the plurality of types of data measured in the rinsing process and the pre-learned ANN is the first step, which is a low degree of tangling, the controller 60 may set (change) the preset allowable UB value to the smaller first value.

In addition, when the determined laundry-tangled degree is the second step (that is, the step greater than the first step), which has a higher degree of tangling, the controller 60 may set (change) the preset allowable UB value to the second value, which is larger than the first value. The controller 60 may use a UB table that includes information (data) of the allowable UB value set for each laundry-tangled degree classified into a plurality of categories so as to set (or change) the preset allowable UB value to a UB value associated with the measured laundry amount and laundry-tangled degree.

The UB table may be pre-stored in the memory 78 or the controller 60.

FIG. 7A illustrates an example UB table in related art, where the allowable UB value is set for each rotational speed section according to each laundry amount. That is, the related art UB table is a fixed UB table classified only by the laundry amount.

FIG. 7B illustrates an example UB table according to the present disclosure.

In some implementations, the UB table, as illustrated in FIG. 7B, a plurality of laundry-tangled degrees may be classified according to each laundry amount, and the allowable UB value of each dewatering operation section (first to $n^{th}$ sections) may be set according to each laundry-tangled degree.

In other words, the controller 60 may set the preset allowable UB value based on a UB table that includes information of the allowable UB value set for each of the plurality of laundry-tangled steps (classes) according to each laundry amount.

In the UB table, the laundry-tangled degree may be classified into a plurality of laundry-tangled degrees according to each laundry amount, and the allowable UB value may be preset for each dewatering operation section according to each of the plurality of laundry-tangled degrees.

The controller 60 may change the preset allowable UB value based on the UB table including information of the allowable UB value set for each of the plurality of laundry-tangled degrees. That is, the UB table employed in the present disclosure may be named as an active UB table.

Referring to FIG. 7B, the UB table includes the plurality of classified laundry-tangled degrees according to each laundry amount, and the allowable UB value may be preset for each dewatering operation section according to each of the plurality laundry-tangled degrees.

Taking a fourth level (level 4) of the detected laundry amount, and a first section of the dewatering process (for example, a section at which rotation of the washing tub 4 is maintained at 108 RPM) as an example, the allowable UB value may be set to a0 (e.g., a first value) in case the laundry tangled-degree is a first step (class 1) (laundry is slightly tanged), and the allowable UB value may be set to a1, larger than the a0, (e.g., a second value which is larger than the first value), in case the laundry-tangled degree is a second step (class 2) (laundry is severely tangled), which is higher than the first step.

Similarly, the allowable UB value of each rotational speed section (a0, b0, c0, . . . , f0) of the first step (class) of the laundry-tangled degree may be smaller than the allowable UB value of each rotational speed section (a1, b1, c1, . . . , f1) of a second step (class) of the laundry-tangled degree.

In other words, the allowable UB value of each rotational speed section (a1, b1, c1, . . . , f1) of the second laundry-tangled step (class) may be set (linked) larger than the allowable UB value of each rotational speed section (a0, b0, c0, . . . , f0) of the first laundry-tangled step (class).

Based on the UB table, the controller 60 may determine the allowable UB value associated with the laundry amount and laundry-tangled degree output through the pre-learned ANN.

Specifically, based on the UB table, the controller 60 may determine the allowable UB value associated with the laundry amount and the laundry-tangled degree output through the pre-learned ANN, and initialize (interrupt) the dewatering process when the UB value, generated by rotation of the washing tub, exceeds the allowable UB value associated with the determined laundry amount and laundry-tangled degree.

For example, when the sensed laundry amount is the fourth level (level 4), and the output laundry-tangled degree is the first step (class 1), the controller 60 may determine whether to stop the rotation of the washing tub (whether to initialize (interrupt) the dewatering process) by comparing the allowable UB value (a0, b0, c0, . . . , f0) related to the fourth laundry-amount level and the first laundry-tangled step (class) with the UB value, generated by rotation of the washing tub 4 during the dewatering process.

As another example, when the sensed laundry amount is the forth level (level 4), and the output laundry-tangled degree is the second step (class 2), the controller 60 may set the allowable UB value to the allowable UB value (a1, b1, c1, . . . , f1) related to the fourth laundry-amount level and the second laundry-tangled step (class). Thereafter, the controller 60 may determine whether to stop rotation of the washing tub 4 (whether to initialize (interrupt) the dewatering process) by comparing the allowable UB value (a1, b1, c1, . . . , f1) related to the second laundry-tangled step with the UB value, generated by rotation of the washing tub 4 during the dewatering process.

Thereafter, the controller may initialize (interrupt) the dewatering process when the UB value of each dewatering operation section, generated by rotation of the washing tub 4, exceeds the allowable UB value associated with the detected laundry amount and laundry-tangled degree. That is, when the UB value, generated by the rotation of the washing tub 4, exceeds the allowable UB value associated with the detected laundry amount and tangled-laundry degree, the controller 60 stops the rotation of the washing tub 4 to re-run the dewatering process from the beginning (or from a section after detecting a dewatered laundry amount).

If the UB value, generated by rotation of the washing tub 4, is lower than or equal to the allowable UB value associated with the detected laundry amount and laundry-tangled degree, the controller 60 may continue the dewatering process (that is, it may accelerate (increase) rotational speed of the washing tub, or entering the high-speed dewatering operation section or entering the next dewatering operation section may be available).

Hereinafter, it is assumed that the laundry amount is one specific laundry amount (e.g., the laundry amount is the fourth level (level 4)) to explain that the allowable UB value is changed depending on the laundry-tangled degree (or a different UB value is applied depending on the laundry-tangled degree even in the same specific laundry amount).

When the laundry-tangled degree is determined as the first step (class 1), the controller 60 may determine whether to stop rotation of the washing tub 4 (that is, whether to initialize (interrupt) the dewatering process) based on the allowable UB value (a0, b0, c0, . . . , f0) associated with the first laundry-tangled step (class 1).

For example, rotational speed of dewatering operation sections may be increased in order from the first section to the $n^{th}$ section. Accordingly, the rotational speed may be the highest in the $n^{th}$ section.

In some implementations, the allowable UB value may gradually increase from a to f. However, the present disclosure is not limited to this, the allowable UB value may gradually decrease from a to f. This may vary or be determined depending on the user settings.

In case the laundry-tangled degree is determined as the first step (class 1), the controller 60 may stop rotation of the washing tub 4 to initialize the dewatering process when the UB value of the washing tub measured in the first section exceeds the allowable UB value (a0) associated with the first laundry-tangled step (class 1).

In case the laundry-tangled degree is determined as the second step (class 2) (a higher degree of laundry tangling), the controller 60 may stop rotation of the washing tub 4 to initialize the dewatering process when the UB value of the washing tub measured in the first section exceeds the allowable UB value (a1) associated with the second laundry-tangled step (class 2). For example, the first section may be a section at which rotational speed of the washing tub 4 is maintained at 108 RPM.

Here, in case the laundry-tangled degree is determined as the second step (class 2), the controller 60 may continue the dewatering process without stopping rotation of the washing tub 4 when the UB value measured in the first section is smaller than the allowable UB value (a1) associated with the second laundry-tangled degree (class 2), and larger than the allowable UB value (a0) related to the first laundry-tangled degree (class 1).

It is assumed that the laundry amount is the fourth level (level 4), the allowable UB values related to the first section is a0=50 and a1=100, and the UB value measured in the first section is 75.

In some implementations, the controller 60 may initialize (interrupt) the dewatering process when the laundry-tangled degree output through the pre-learned ANN is the first step (class 1) (laundry is slightly tangled). This is because the UB value of 75 exceeds the allowable UB value of 50 associated with the first laundry-tangled degree (class 1). In this case, the controller 60 may restart the dewatering process from the beginning (or from a section after detecting the dewatered laundry amount) to perform the laundry balancing (laundry diffusion) process so as to untangle (evenly distribute) the laundry by rotating the washing tub at a low RPM, and to perform dewatering by rotating the washing tub at a high RPM when the UB value measured in the first section is 50 or smaller.

Accordingly, in the present disclosure, laundry balancing is properly performed even in the case of a low degree of laundry tangling. Thus, noise at a high RPM section may be reduced, and a possibility of occurrence of abnormal vibration may also be reduced.

In some implementations, the controller 60 may continue the dewatering process when the laundry-tangled degree output through the pre-learned ANN is the second step (class 2) (laundry is severely tangled). This is because the UB value of 75 is lower than or equal to the allowable UB value of 100 associated with the second laundry-tangled degree (class 2). In this case, the controller 60 sets (changes) the allowable UB value to be higher to prevent interruption of the dewatering process from being frequently occurred, caused by the UB value exceeding the allowable UB value. Thus, a dewatering time may be reduced.

Like this, in the present disclosure, an optimized effect can be provided for both the laundry having a low degree of tangling and the laundry having a high degree of tangling by applying (or changing) the allowable UB value differently depending on the laundry-tangled degree even in the same laundry amount.

In the washing machine according to the present disclosure, a plurality of types of data is measured while the washing tub 4 rotates at specific rotational speed during the rinsing process, and the measured plurality of types of data is input into the pre-learned ANN to determine the laundry-tangled degree as an output value.

Thereafter, the washing machine may set the allowable UB value differently according to the laundry tangled degree. In the case of laundry having a low degree of tangling, the UB value is set to be small to perform an additional laundry balancing process so as to reduce noise at the high-speed dewatering operation section. And in the case of laundry having a high degree of tangling, the allowable UB value is set to be large to prevent frequent stopping of the dewatering process, which may result in the decreased dewatering time.

The controller 60 may detect the laundry-tangled degree using the pre-learned ANN when a preset condition is satisfied. The preset condition may include at least one of, for example, the completion of the rinsing stroke and the normal completion of laundry amount detection.

In other words, detecting the laundry-tangled degree using the pre-learned ANN (S320) may be performed, in response to at least one of the completion of the rinsing stroke and the normal completion of laundry amount (dewatered laundry amount) detection.

In some examples, the controller 60 may not detect the laundry-tangled degree when the preset condition is not satisfied.

The case for unsatisfied preset condition (i.e., the condition that the detection of the laundry-tangled degree is not performed) may include every condition in which rinsing is not normally completed (Power off, IE, OE, LE, etc.), a condition in which detecting the laundry amount is not normally completed, a condition in which a second to a fourth tumbling motion during rinsing is not started or skipped without completing a preset ON time, a condition in which there is a pause in the final rinsing, a course that fails to obtain data as a rinsing time is over before the fourth tumbling motion is finished, a case where a rinsing tumbling motion is performed less than four times, a case where a predetermined number of input data is not completely input, and the like.

In this case, the controller 60 may determine whether to stop rotation of the washing tub 4 based on the allowable UB value (for example, related to a third step (class 3) in case the maximum step (class) of the laundry-tangled degree is the third step (class 3)) related to the highest step (class) of laundry-tangled degree.

In some implementations, when the laundry-tangled degree is incorrectly detected, for example, an actual laundry-tangled degree is the third step (class 3) (laundry is severely tangled), but the laundry-tangled degree output from the ANN is the first step (class 1) (laundry is slightly tangled), the allowable UB value is set to be small (low), which may result in frequent initialization (interruption) of the dewatering process. In this case, the dewatering time is extended.

When a predetermined time period (e.g., 300 seconds) has passed after entering the dewatering process (for example, after completing detection of the laundry amount), the controller 60 may apply the allowable UB value associated with the highest degree of tangled laundry in the UB table (that is, the highest allowable UB value applied to the highest laundry-tangled degree for the corresponding laundry amount, the largest allowable value for the corresponding laundry amount) to perform the dewatering process. This may prevent the dewatering time from being indefinitely extended.

The washing machine according to the present disclosure changes (sets) the allowable UB value to be small, which is a criterion for interrupting (initializing) the dewatering process (or a criterion for stopping rotation of the washing tub 4), to prevent the dewatering process from being performed at high-speed without performing the laundry balancing process. Thus, an occurrence rate of noise and abnormal vibration may be reduced.

In other words, in the washing machine according to the present disclosure, in the case of laundry having a low degree of tangling, the dewatering process may be performed in a UB-minimized state through the laundry balancing process by setting the allowable UB value to be small. Accordingly, noise and abnormal vibration may be reduced.

In addition, in the case of laundry having a high degree of tangling, even though the laundry balancing process is performed through interruption (initialization) of the dewatering process, laundry is not evenly loaded (distributed) due to a high degree of tangling. Accordingly, the number of cases for the UB value measured in the dewatering process exceeding the preset UB value is increased. Therefore, the number of dewatering interruption (initialization) cases is increased, resulting in a prolonged dewatering time.

However, in the washing machine according to the present disclosure, in the case of laundry having the high degree of tangling, the allowable UB value is set to be large so as to minimize the number of cases for the UB value exceeding the allowable UB value. Accordingly, the number of dewatering interruption (initialization) cases is reduced, resulting in a reduced dewatering time.

In this specification, the controller 60 initializes (interrupts) the dewatering process when the measured UB value exceeds the preset allowable UB value, but the present disclosure is not limited thereto.

The controller 60 may control the washing tub 4 to rotate (decelerate) the washing tub 4 at rotational speed (for example, 80 RPM or lower), at which laundry can fall without being attached to the washing tub so that the laundry balancing process is performed (or laundry is untangled).

In this specification, description of the controller 60 initializing (interrupting) the dewatering process may be understood that the controller 60 rotates (decelerates) the washing tub 4 at rotational speed (for example, 80 RPM or lower), at which laundry can fall without being attached to the washing tub according to product design or user settings.

The above description may be equally applied to a washing machine control method. The washing machine control method, for example, may be performed by the controller 60. According to an implementation of the present disclosure, one or more of the following effects can be provided.

According to the implementation of the present disclosure, one or more of the following effects can be provided.

First, according to the present disclosure, an AI powered washing machine capable of performing optimized dewatering by setting (changing) an allowable UB value, which is a criterion for interrupting (initializing) a dewatering process (stroke), so as to correspond to an allowable UB value related to a laundry amount and laundry-tangled degree. Second, the present disclosure can provide an optimized washing machine capable of reducing a dewatering time by changing an allowable UB value based on a laundry-tangled degree even in the same amount of laundry each time when a dewatering process is performed. Thus, in the case of laundry having a low degree of tangling, the allowable UB value is set to be small so as to reduce noise generated during dewatering, and in the case of laundry having a high degree of tangling, the allowable UB value is set to be large so as to reduce a dewatering time, and a method for controlling the same.

Third, the present disclosure can provide a washing machine capable of performing sophisticated dewatering control by setting an allowable UB value differently according to a laundry-tangled degree as well as a laundry amount by using a UB table classified into a plurality of laundry-tangled degrees according to each laundry amount, and a method for controlling the same.

The effects of the present disclosure are not limited to those effects mentioned above, and other effects not mentioned may be clearly understood by those skilled in the art from the description of the appended claims.

The present disclosure can be implemented as computer-readable codes in a program-recorded medium. The computer-readable medium may include all types of recording devices each storing data readable by a computer system. Examples of such computer-readable media may include hard disk drive (HDD), solid state disk (SSD), silicon disk drive (SDD), ROM, RAM, CD-ROM, magnetic tape, floppy disk, optical data storage element and the like. The computer may include the processor or the controller. Therefore, it should also be understood that the above-described implementations are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. A washing machine, comprising:

a washing tub configured to accommodate laundry therein;

a motor configured to rotate the washing tub; and a controller configured to:

determine a laundry amount and a laundry-tangled degree by using a plurality of types of data that are measured while rotating the washing tub at a specific rotational speed, set an allowable unbalance (UB) value corresponding to the laundry amount and the laundry-tangled degree, determine a UB value based on rotating the washing tub during a dewatering stroke, and control the motor to stop rotating the washing tub based on the UB value exceeding the allowable UB value.

2. The washing machine of claim 1, wherein the controller is configured to set a different allowable UB value based on a change of one or both of the laundry amount and the laundry-tangled degree.

3. The washing machine of claim 1, wherein the controller is configured to:

during a rinsing stroke prior to the dewatering stroke, obtain the plurality of types of data based on rotating the washing tub at the specific rotational speed in which the laundry is lifted up by a predetermined height and then falls in the washing tub.

4. The washing machine of claim 1, wherein the controller is configured to:

input the plurality of types of data as an input value to a pre-learned Artificial Neural Network (ANN) that is configured to output the laundry-tangled degree as a result value.

5. The washing machine of claim 4, wherein the controller is configured to, based on operation through the pre-learned ANN, determine one of a plurality of laundry-tangled degrees, the pre-learned ANN being configured to classify each of the plurality of laundry-tangled degrees into one of a plurality of steps.

6. The washing machine of claim 1, wherein the controller is configured to:

set the allowable UB value to a first value based on the laundry-tangled degree corresponding to a first step; and set the allowable UB value to a second value that is greater than the first value based on the laundry-tangled degree corresponding to a second step that is greater than the first step.

7. The washing machine of claim 1, wherein the controller is configured to:

set the allowable UB value based on a UB table, the UB table comprising a plurality of allowable UB values that have been determined based on a plurality of laundry amounts and a plurality of laundry-tangled degrees, each of the plurality of laundry-tangled degrees being classified into one of a plurality of steps.

8. The washing machine of claim 7, wherein one of the plurality of laundry amounts corresponds to the plurality of laundry-tangled degrees, wherein the dewatering stroke comprises a plurality of dewatering operation sections, and wherein the controller is configured to, for each of the plurality of dewatering operation sections, set a plurality of allowable section UB values according to the plurality of laundry-tangled degrees, respectively.

9. The washing machine of claim 8, wherein the controller is configured to:

set the UB table to include the plurality of allowable section UB values, each of the plurality of allowable section UB values being associated with one of the plurality of laundry amounts and one of the plurality of laundry-tangled degrees that is output through a pre-learned ANN;

determine a section UB value based on rotating the washing tub in a rotational speed during one of the plurality of dewatering operation sections; and interrupt the dewatering stroke based on the section UB value exceeding one of the plurality of allowable section UB values that is associated with the one of the plurality of laundry amounts and the one of the plurality of laundry-tangled degrees.

10. The washing machine of claim 1, further comprising:

a sensor configured to detect a variation of a rotational speed of the washing tub, wherein the controller is configured to determine the UB value based on the variation of the rotational speed of the washing tub detected during the dewatering stroke.

* * * * *